US009080355B2

(12) United States Patent
Brose et al.

(10) Patent No.: US 9,080,355 B2
(45) Date of Patent: Jul. 14, 2015

(54) CIRCUIT AND METHOD FOR PREVENTING INADVERTENT OPENING OF A VEHICLE DOOR

(75) Inventors: Simon Brose, Hattingen (DE); Klaus Dünne, Ratingen (DE); Rainer Wirths, Wuppertal (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 567 days.

(21) Appl. No.: 12/971,772

(22) Filed: Dec. 17, 2010

(65) Prior Publication Data

US 2011/0181056 A1 Jul. 28, 2011

(30) Foreign Application Priority Data

Dec. 18, 2009 (DE) ..... 10 2009 059 084
Dec. 18, 2009 (DE) ..... 20 2009 017 298 U

(51) Int. Cl.

| | |
|---|---|
| ***E05B 3/00*** | (2006.01) |
| ***E05B 81/76*** | (2014.01) |
| ***E05B 81/14*** | (2014.01) |
| ***E05B 81/56*** | (2014.01) |

(52) U.S. Cl.
CPC ..... *E05B 81/76* (2013.01); *E05B 81/14* (2013.01); *E05B 81/56* (2013.01)

(58) Field of Classification Search
USPC ..... 292/336.3
See application file for complete search history.

(56) References Cited

U.S. PATENT DOCUMENTS

| | | | | |
|---|---|---|---|---|
| 5,078,436 | A | 1/1992 | Kleefeldt et al. | |
| 5,435,609 | A | 7/1995 | Igata et al. | |
| 5,715,712 | A | 2/1998 | West | |
| 5,777,395 | A * | 7/1998 | Rathmann | 307/10.2 |
| 5,887,466 | A | 3/1999 | Yoshizawa | |
| 5,901,991 | A * | 5/1999 | Hugel et al. | 292/201 |
| 6,002,341 | A | 12/1999 | Ohta et al. | |
| 6,304,168 | B1 | 10/2001 | Ohta et al. | |
| 6,367,295 | B1 | 4/2002 | Agostini et al. | |

(Continued)

FOREIGN PATENT DOCUMENTS

| | | |
|---|---|---|
| DE | 4202698 | 9/1993 |
| DE | 10258646 | 5/2004 |

(Continued)

OTHER PUBLICATIONS

German Search Report from corresponding German Application No. 202009017298.8, dated Sep. 2, 2010, 4 pages.

*Primary Examiner* — Mark Williams
(74) *Attorney, Agent, or Firm* — Pauly, DeVries Smith & Deffner, LLC

(57) ABSTRACT

Described herein is a circuit arrangement for a motor vehicle door having a detent mechanism which keeps the motor vehicle door in the closed position and opens it and at least one operating element, for example, an outer door handle and/or inner door handle, wherein an electric drive, for example, an electric motor, drives the detent mechanism, and the motor can be connected by means of a control module. In one embodiment, at least one electrical switching element is arranged in the circuit of the motor. In another embodiment, when the operating element is operated, the electrical circuit of the motor can be completed by means of the electrical switching element. Also described is a method for actuating a detent mechanism in a motor vehicle door and a controller for a detent mechanism which keeps a motor vehicle door in the closed position or opens it.

11 Claims, 9 Drawing Sheets

(56) References Cited

U.S. PATENT DOCUMENTS

| | | | | |
|---|---|---|---|---|
| 6,847,289 | B2 | 1/2005 | Pang et al. | |
| 6,879,058 | B2 * | 4/2005 | Lorenz et al. | 307/10.1 |
| 7,091,836 | B2 | 8/2006 | Kachouh et al. | |
| 7,589,431 | B2 | 9/2009 | Hentsch et al. | |
| 7,926,857 | B2 | 4/2011 | Akizuki et al. | |
| 7,963,921 | B1 | 6/2011 | Freund et al. | |
| 2001/0048227 | A1 | 12/2001 | Kachouh | |
| 2002/0036408 | A1 | 3/2002 | Jang | |
| 2003/0182863 | A1 * | 10/2003 | Mejean et al. | 49/26 |
| 2004/0160126 | A1 | 8/2004 | Aoki et al. | |
| 2007/0018790 | A1 | 1/2007 | LaFrance | |

FOREIGN PATENT DOCUMENTS

| | | |
|---|---|---|
| DE | 10331497 | 1/2005 |
| EP | 0589158 | 3/1994 |
| WO | 99/53162 | 10/1999 |

* cited by examiner

CIRCUIT AND METHOD FOR PREVENTING INADVERTENT OPENING OF A VEHICLE DOOR

CROSS-REFERENCE TO RELATED APPLICATIONS

This application claims priority to German Utility Model No. 20 2009 017 298.8 and German Patent Application 10 2009 059 084.6 by Brosse Schließsysteme GmbH & Co. KG, filed Dec. 18, 2009.

FIELD OF THE INVENTION

The present invention relates to a motor vehicle lock that can be used in side doors, trunks, tailgates and folding window panes of motor vehicles.

BACKGROUND

EP 0 589 158 B1 discloses a lock having a latch which, when operatively connected to a shackle, keeps a vehicle door in the closed position. A detent pawl and the latch are in a positively locking connection in the closed state. The positively locking connection between latch and detent pawl can be broken by means of an electric actuating drive by virtue of the electric actuating drive exerting a force on the detent pawl which brings about a pivot movement by the detent pawl and breaks the positively locking connection between latch and detent pawl.

The electric actuating drive is supplied with electric current by means of a controller which is powered by means of the vehicle battery. The signal to open the motor vehicle door is supplied to the controller by two microswitches which are operated by means of the outer door handle or the inner door handle of the motor vehicle door. These signals are used by the controller to enable the supply of current to the electric actuating drive.

For safety reasons, the controller has a relay connected to it which interrupts the supply of current to the electric actuating drive when the vehicle is not stationary, for example, which means that the electric actuating drive cannot be actuated by the central motor vehicle electronics.

DE 103 60 422 A1 shows a circuit in which the outer door handle and the inner door handle each operate a sensor. The sensor comprises two switches and two resistors. A respective switch and resistor are connected in series, with the series-connected resistor/switch elements being arranged in parallel. The resistors are used for resistance coding, wherein the switches complete the circuit. On the basis of this resistance coding, the controller can recognize an erroneous signal and react accordingly. Furthermore, when a line is disconnected, the signal can be passed on to the controller via the second parallel-led resistor/switch element. The controller is then connected directly to the lock or to the electric actuating drive.

Both EP 0 589 158 B1 and DE 103 60 422 A1 involve the controller being connected directly to the electric actuating drive. As such, it is possible to open a motor vehicle door inadvertently on the basis of an erroneous signal from the controller. In this case, the motor vehicle door could open during the journey, for example, and put both the vehicle occupants and vehicles in proximity at risk. In order to avoid this, DE 100 42 191 A1 describes a lock which mechanically couples the electric actuating drive when the inner door handle or outer door handle is operated. To this end, the electric actuating element and the detent pawl have a mechanical coupling arranged between them which is operated by means of the outer door handle and/or the inner door handle. When the outer door handle or inner door handle is not being operated, the mechanical connection between the electric actuating element and the detent pawl is interrupted. If the electric actuating element is supplied with current on account of an error in the controller, the movement comes to nothing. The motor vehicle door does not open. If the inner door handle and/or the outer door handle is operated, the mechanical connection between the electric actuating element and the detent pawl is completed (coupled). At the same time, the operation of the outer door handle and/or the inner door handle sends a signal to the controller, which signal supplies current to the electric actuating element. Since the mechanical connection between the actuating element and the detent pawl is complete (coupled), the movement is transmitted to the detent pawl and the motor vehicle door is opened. However, a mechanical coupling comprises a plurality of elements which are sensitive to tolerance and the assembly of which is complex. Furthermore, a mechanical coupling produces noise and is sensitive to dirt and icing up.

SUMMARY OF THE INVENTION

The present invention is based on the object of providing a switch arrangement for a motor vehicle door, a method for actuating a detent mechanism and a controller for a detent mechanism which are intended to be used to prevent inadvertent opening of the motor vehicle door while avoiding mechanical coupling.

In one embodiment, the invention provides a circuit arrangement for a motor vehicle door having a detent mechanism which keeps the motor vehicle door in the closed position and opens it and at least one operating element, for example, an outer door handle and/or inner door handle, wherein an electric drive, for example, an electric motor, drives the detent mechanism, and the motor can be connected by means of a control module. In one embodiment, at least one electrical switching element is arranged in the circuit of the motor. In another embodiment, when the operating element is operated, the electrical circuit of the motor can be completed by means of the electrical switching element.

In another embodiment, the invention provides a method for actuating a detent mechanism in a motor vehicle door, in which the detent mechanism keeps the motor vehicle door in the closed position or opens it. In one embodiment, the detent mechanism is opened by an electric drive, for example, an electric motor, in which the motor is connected by a control module and an electrical switching element in the circuit of the motor is closed by an operating element, for example, an outer door handle or inner door handle, and the control module connects the motor current.

In another embodiment, the invention provides a controller for a detent mechanism which keeps a motor vehicle door in the closed position or opens it, which has a control module which connects an electric drive, such as an electric motor, that operates the detent mechanism, in which at least one electrical switching element is arranged in the circuit of the motor, and the electrical switching element is operated by means of an operating element, for example, an outer door handle and/or inner door handle, and upon operation of the electrical switching element, the electrical circuit of the motor is completed, and the motor current is enabled by the control module within a short space of time.

Advantageous refinements of the invention can be found in the respective dependent claims.

BRIEF DESCRIPTION OF THE FIGURES

The invention is described below with reference to exemplary embodiments. In the associated drawings:

Figure 1:
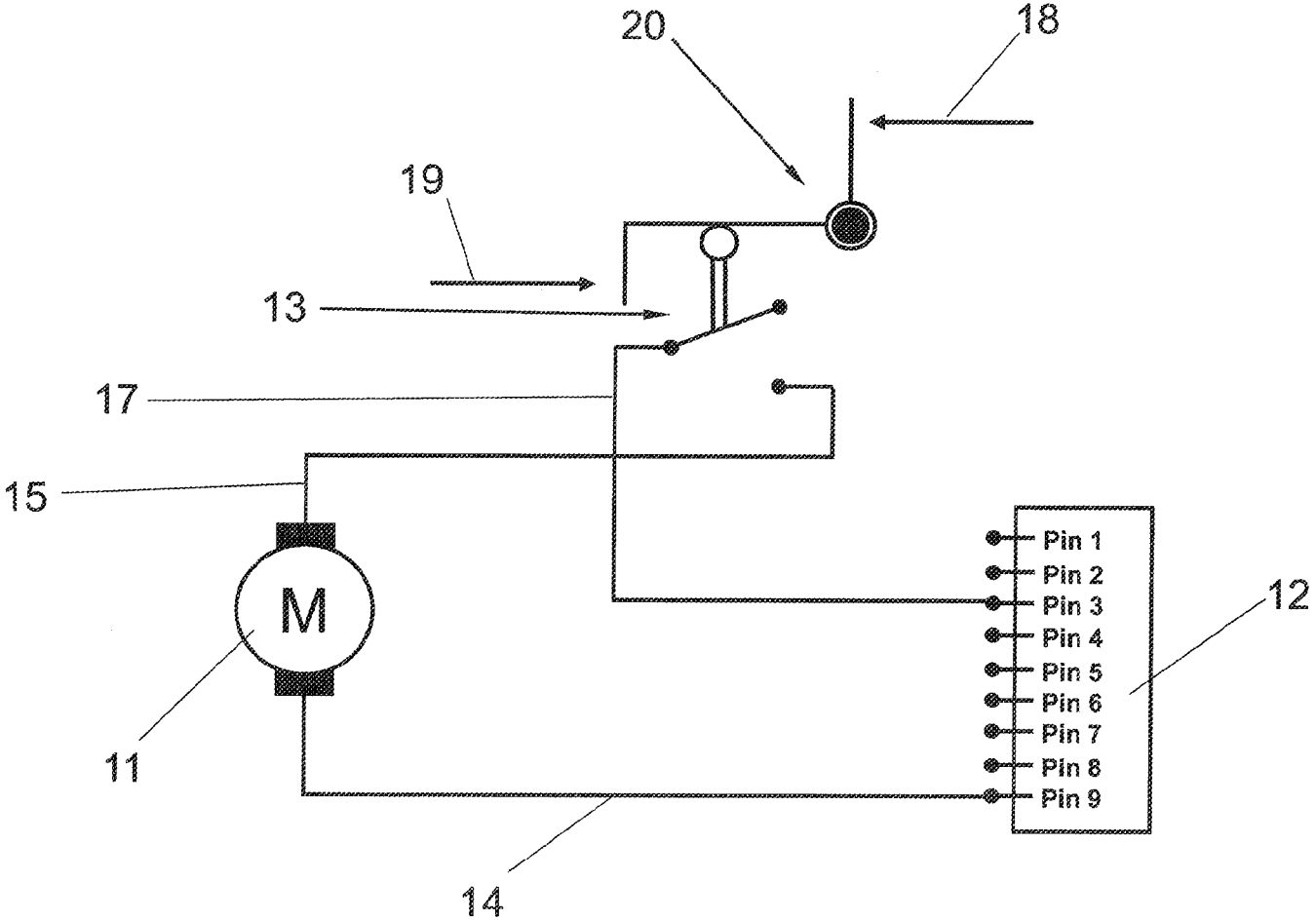
Figure 2:
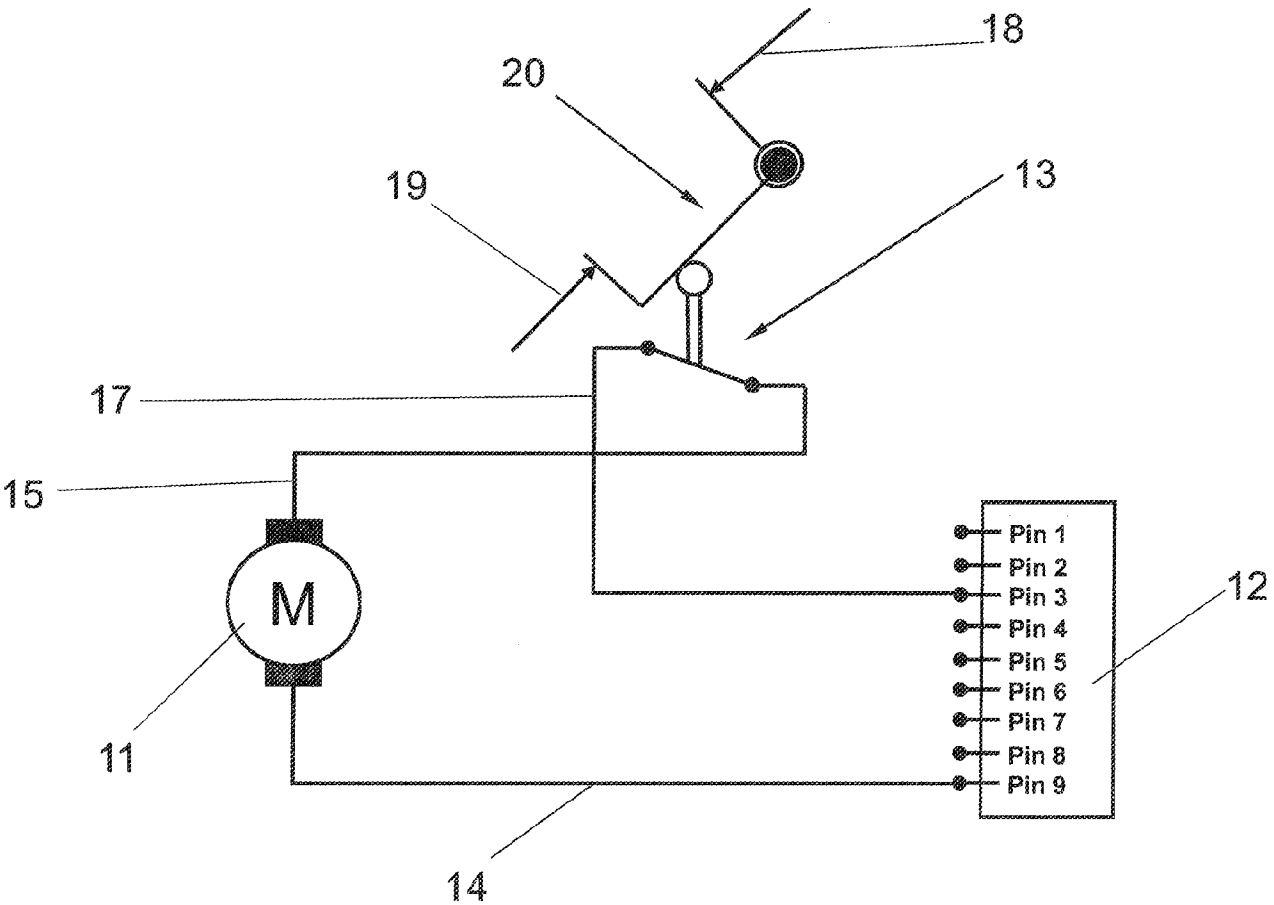
Figure 3:
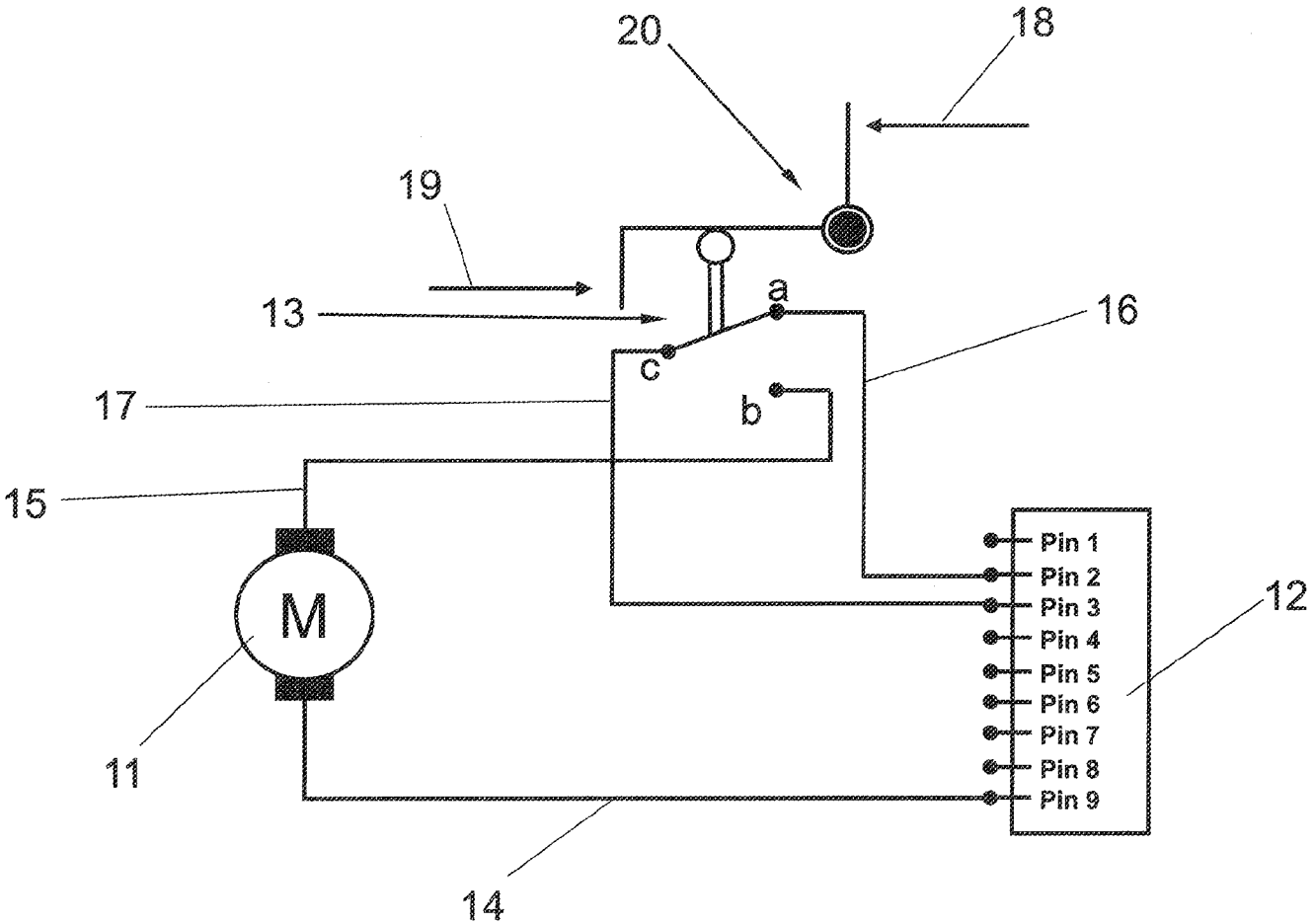
Figure 4:
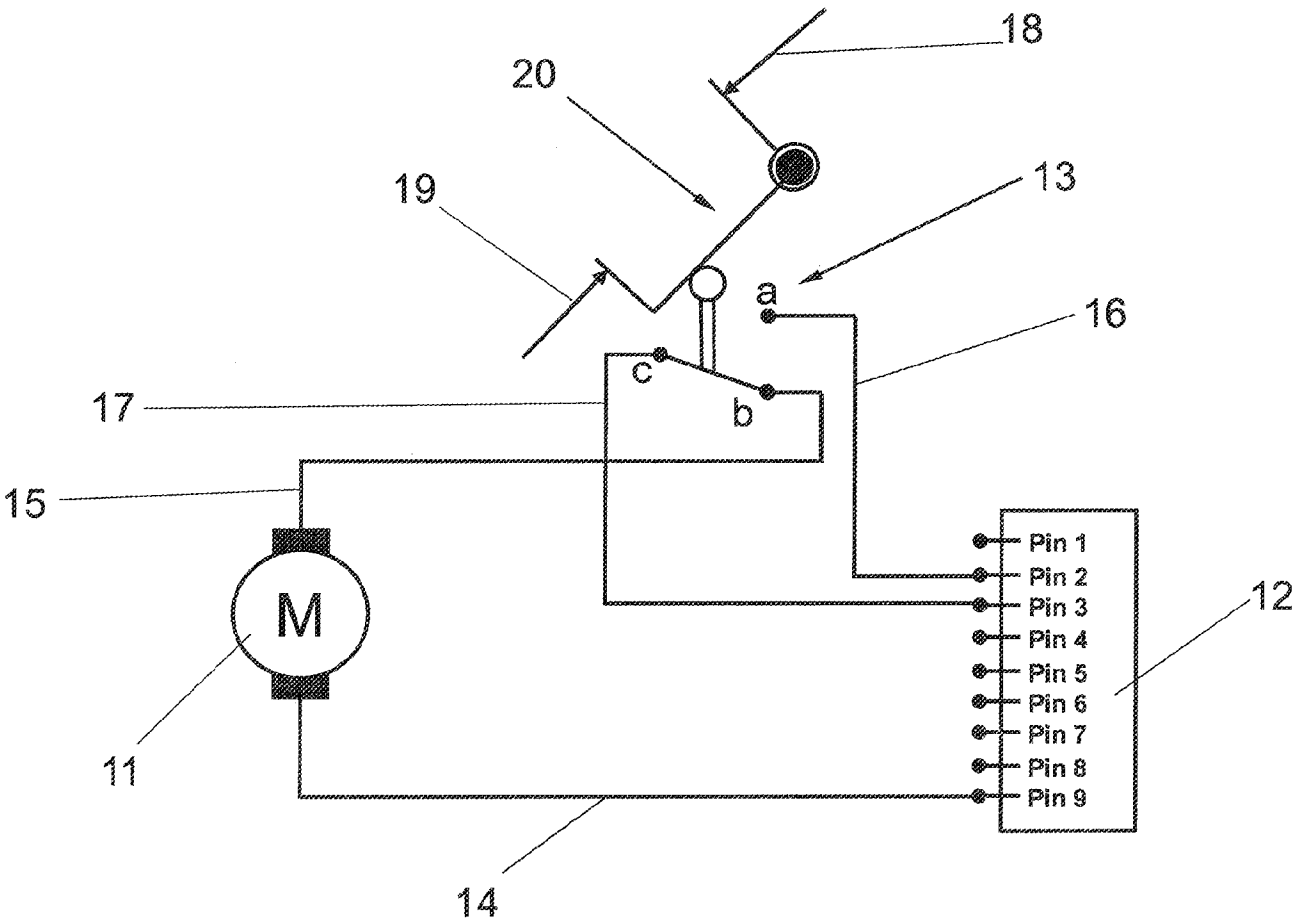
Figure 5:
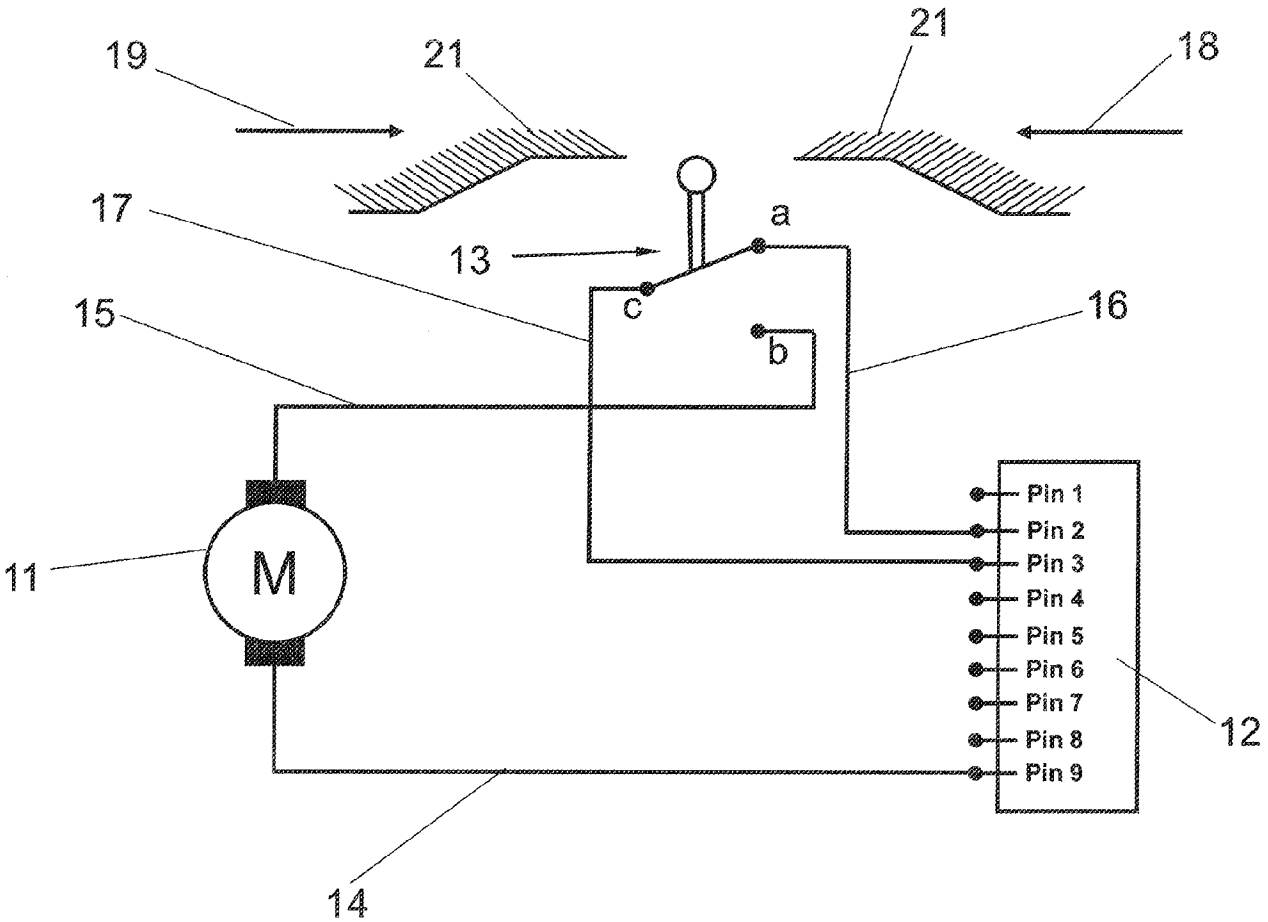
Figure 6:
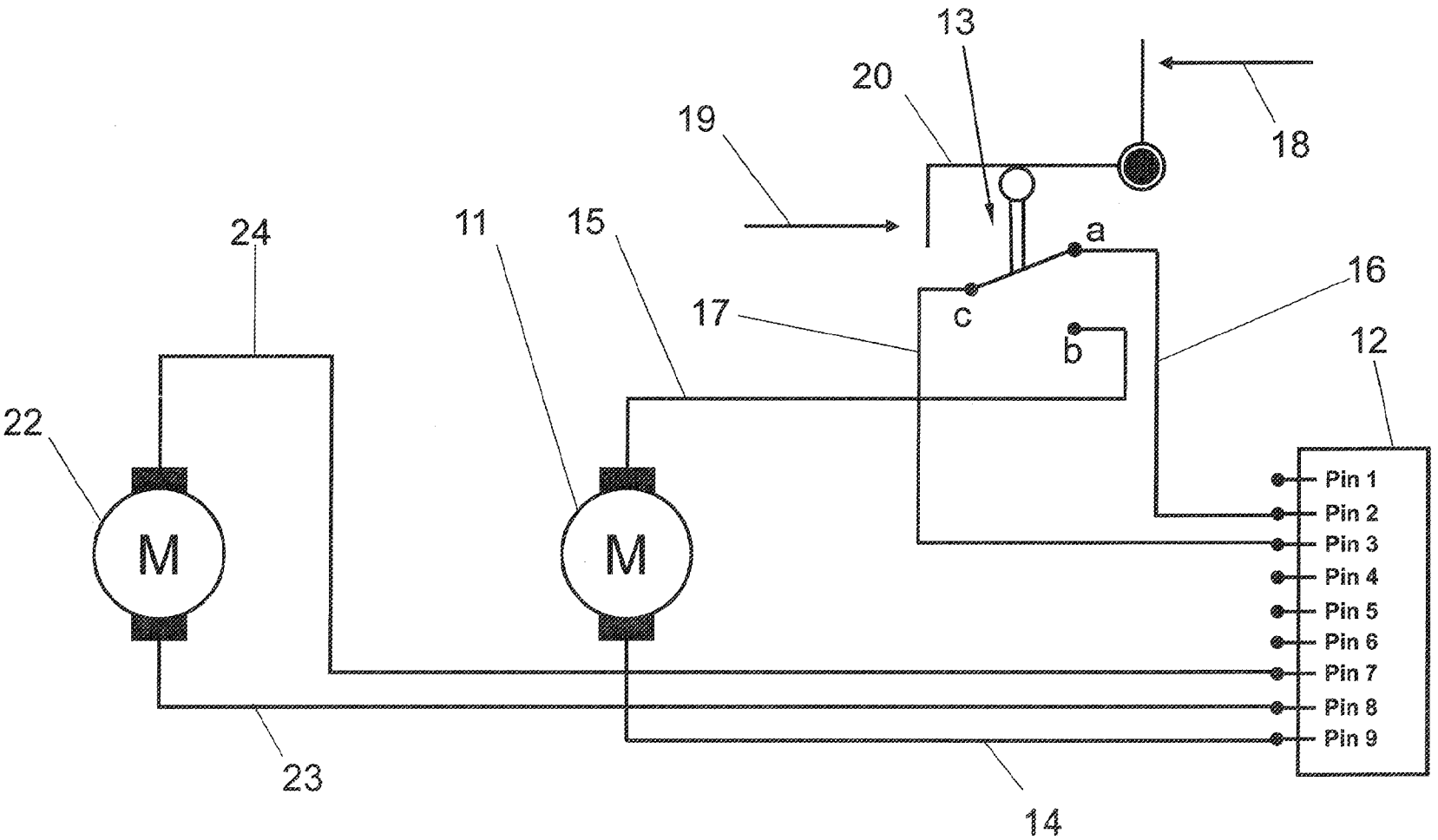
Figure 7:
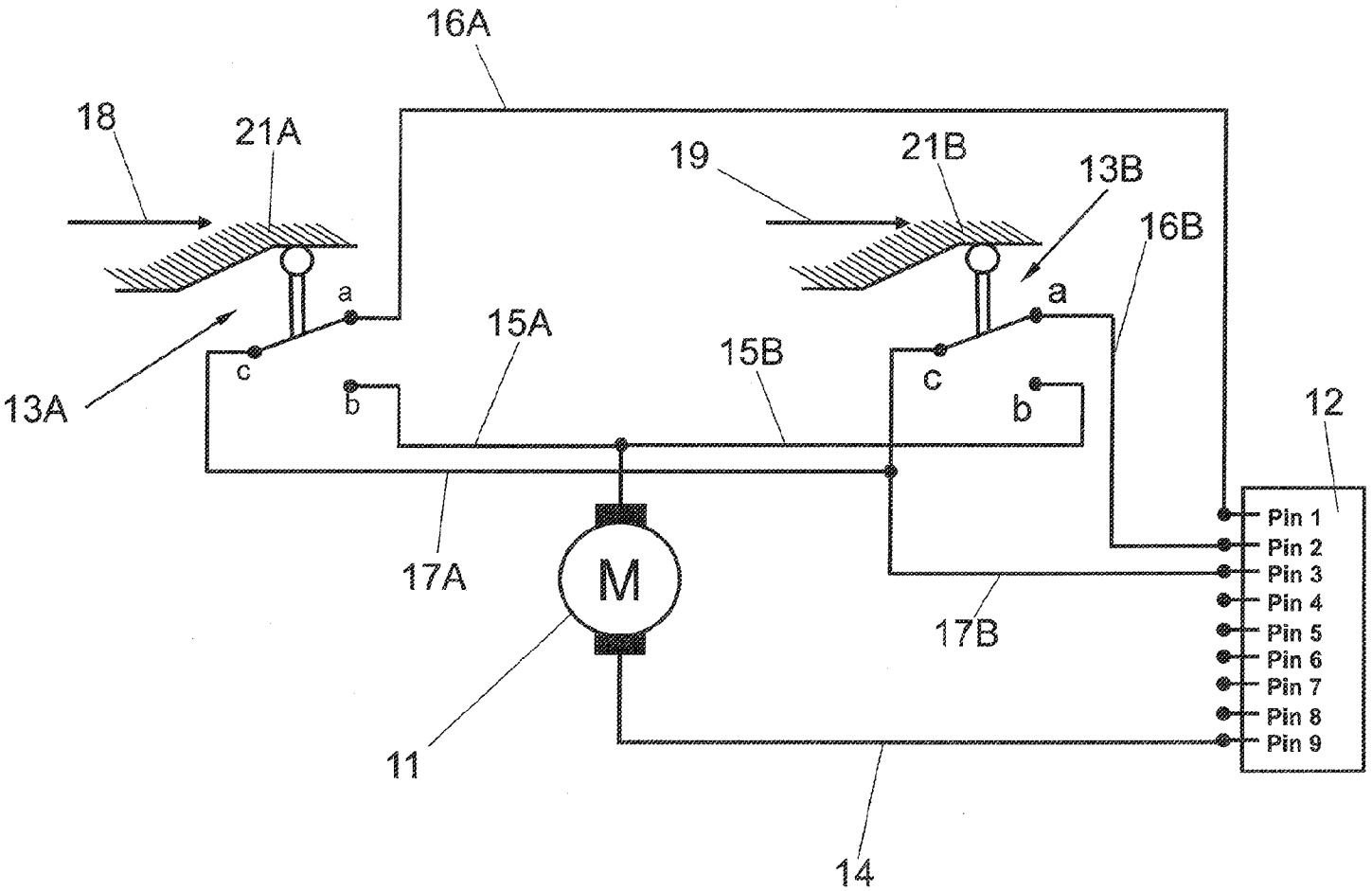
Figure 8:
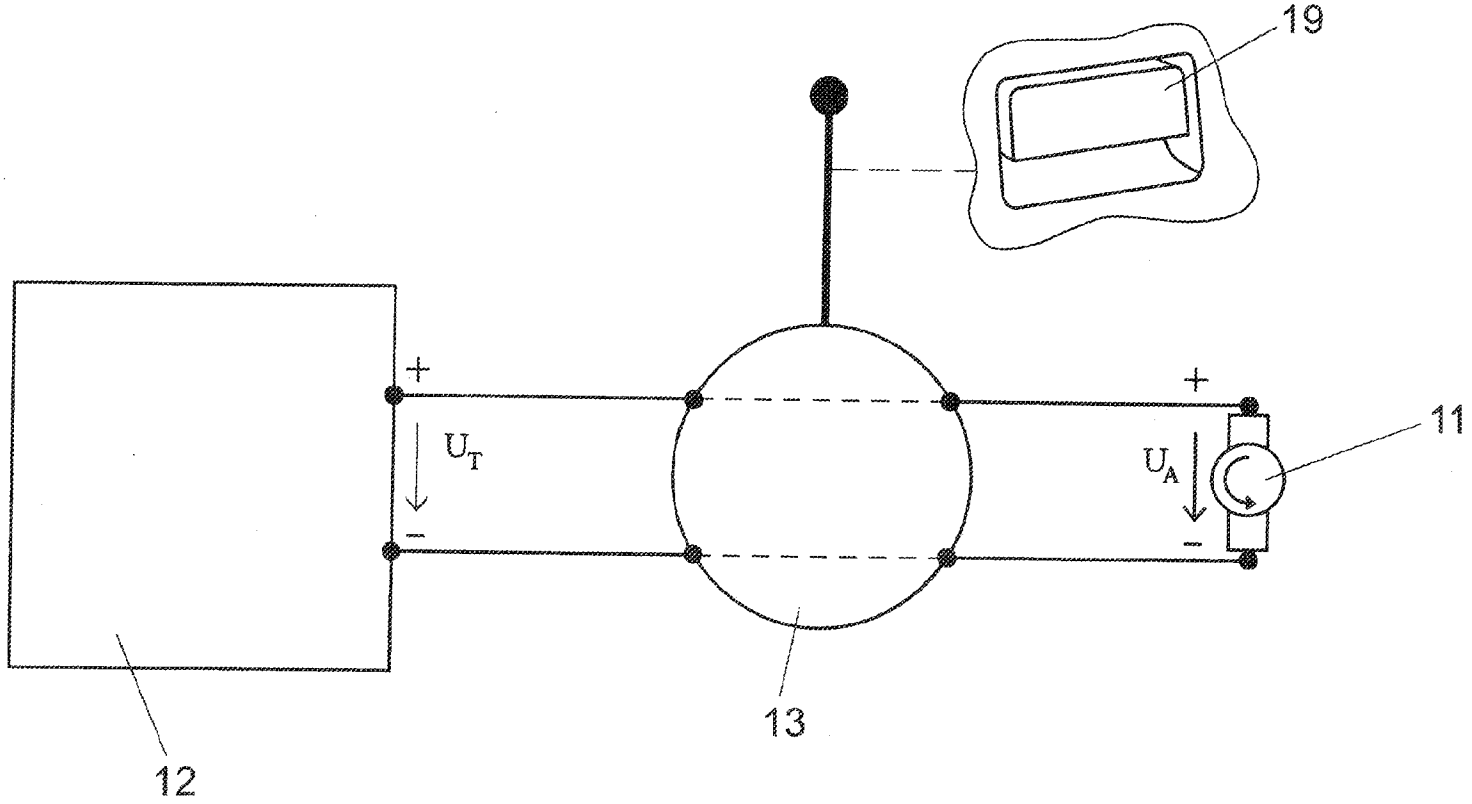
Figure 9:
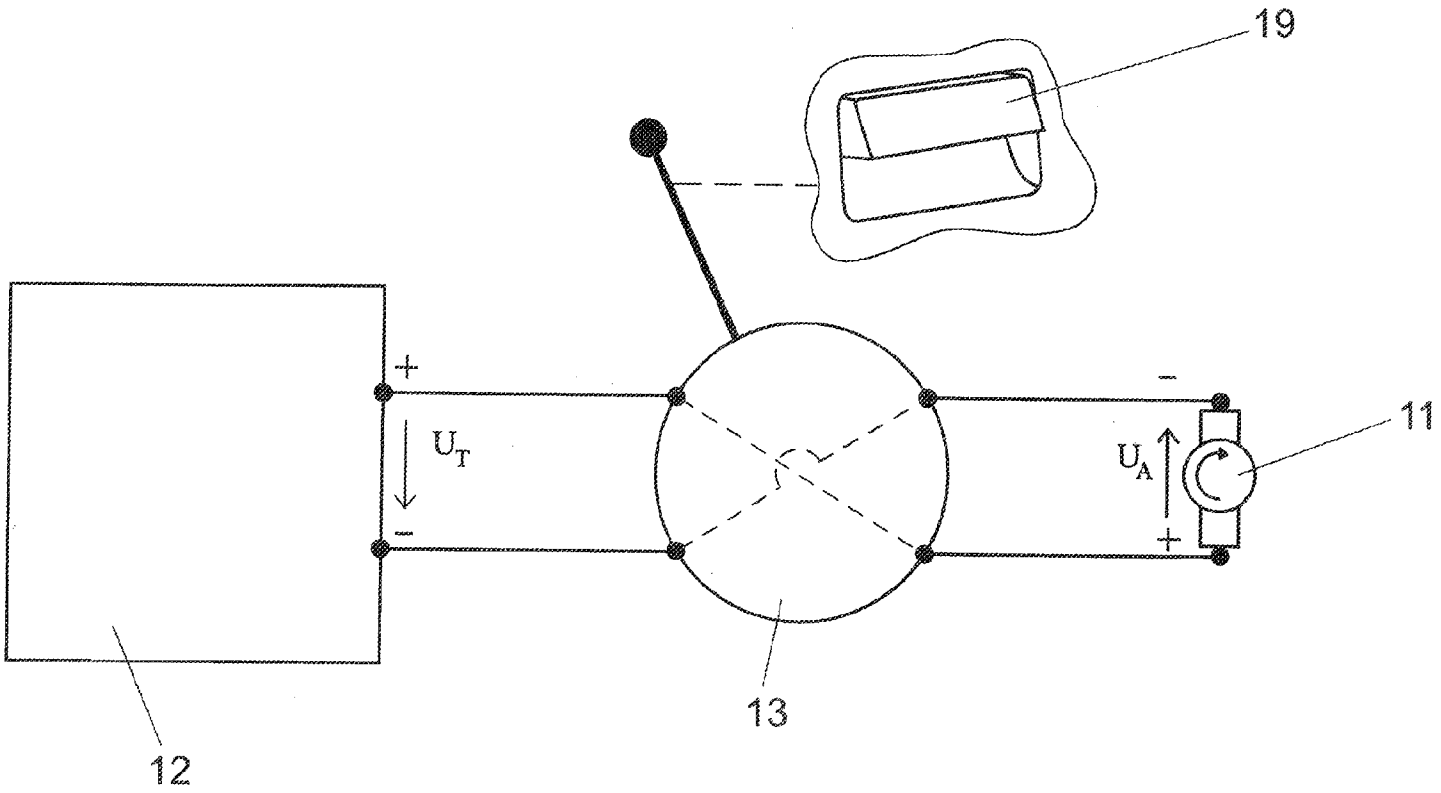

| | |
|---|---|
| FIG. 1 | shows a schematic diagram of the electrical switch arrangement with an electric pushbutton switch when the door handle is not being operated |
| FIG. 2 | shows a schematic diagram as per FIG. 1 when the door handle is being operated |
| FIG. 3 | shows a schematic diagram of the electrical switch arrangement with the toggle switch in the unoperated state |
| FIG. 4 | shows a schematic diagram as per FIG. 3 in the operated state |
| FIG. 5 | shows a schematic diagram of the electrical switch arrangement, wherein the inner door handle and the outer door handle operate the electrical switching element separately |
| FIG. 6 | shows a schematic diagram as per FIG. 3 with an additional closing aid motor |
| FIG. 7 | shows a schematic diagram as per FIG. 5 with two electrical switching elements |
| FIG. 8 | shows a schematic diagram with a switch arrangement for reversing the polarity of a driver voltage when the operating element is not being operated |
| FIG. 9 | shows a schematic diagram as per FIG. 8 when the operating element is being operated |

In the figures, the same reference symbols are used for the same or similar parts. This is intended to indicate that corresponding or comparable properties and advantages are achieved, even if the parts are not described repeatedly.

DETAILED DESCRIPTION

The circuit arrangement according to the invention is used for detent mechanisms in motor vehicle doors. In this context, a motor vehicle door is understood to mean all the moving parts of a motor vehicle (e.g. side doors, sliding doors, gull-wing doors, trunk lids, tailgates, hoods, folding window panes, swing-up hoods for pedestrian protection or headrests which change their position in the event of a crash) which are kept in a prescribed position by means of a detent mechanism. Detent mechanisms are understood to mean mechanical components which are usually positioned in the door and, in conjunction with a mating piece on the bodywork, keep the motor vehicle door closed or open it. For design purposes, the detent mechanisms are positioned in the locks of the motor vehicle doors.

The opening movement of the detent mechanisms is produced by an electric motor. Alternatively, however, it is also possible to use a motor/gear unit, a linear motor, a solenoid, a shape memory element or any other apparatus which converts electrical energy into motion.

The motor current is enabled in the circuit arrangement according to the invention by a control module. In addition, the motor current line contains an electrical switching element. Said switching element is preferably a switch, reed switch, Hall sensor, pushbutton switch, relay or other switching element which interrupts the motor current line in the position of rest. In terms of mechanics, this electrical switching element is operated by the inner operating lever or by the outer operating lever. When the inner operating lever or the outer operating lever is operated, a signal is sent to the control module, on the basis of which signal the control module enables the motor current. The signal can be produced by any desired means. At the same time, operation of the outer operating lever or inner operating lever switches the electrical switching element in the motor current line to the closed position. The motor current can therefore drive the motor, as a result of which the detent mechanism opens the motor vehicle door. If the motor current is connected on account of an error in the control module without the inner operating lever or the outer operating lever having been pulled, the electrical switching element between control module and motor remains in the open position. The motor is therefore unable to start and the detent mechanism cannot open the motor vehicle door.

If the electrical switching element is intended to be used exclusively as a safety element, i.e. the electrical switching element is used primarily to interrupt the motor current line and hence for the safety function, it is recommended that a pushbutton switch, preferably a make contact, be used. The use of a make contact is recommended for operating safety and ease of assembly both in the case of positioning and in the case of installation.

If the electrical switching element is intended to produce and/or pass on further functions of further signals, however, as described later, a toggle switch is preferable. In this context, a toggle switch needs to be selected such that when "not operated" it is automatically switched to the zero position and in the zero position the motor current is interrupted.

For the positioning of the electrical switching element, two variants are preferable. The first variant involves the electrical switching element being positioned as close to the motor as possible. This is preferable from safety aspects, because errors, e.g. on account of shorts owing to damaged lines, do not result in the door being opened. However, this variant requires that the operating force be routed from the outer door handle or inner door handle to the electrical switching element. The second preferred variant involves the electrical switching element being positioned in a door handle unit (inner door handle and/or outer door handle). The positioning of the electrical switching element in a door handle unit makes assembly simple, since the operating force can be transmitted to the electrical switching element relatively easily from design aspects. Alternatively, the electrical switching element can be positioned at any location in the vehicle if this is advantageous on the basis of the vehicle being considered as a whole.

If the electrical switching element is additionally intended to be used to produce a second signal, a two-pole switching element is recommended. In the case of this variant too, it is possible to use all switching elements which contain at least one input and at least two outputs, e.g. switches, reed switches, circuits based on Hall sensors, pushbutton switches or relays. In this variant, when in the unoperated state, the electrical switching element is installed in the motor current line such that the motor is disconnected. A signal current flows via the second pole of the electrical switching element. This signal current can flow via the line either permanently or in pulsed fashion. In order to attain a better energy balance, the signal current can alternatively be introduced into the controller only after a wake-up operation, e.g. by a signal which is introduced into the control module in arbitrary fashion. If, in one of these variants, the inner door handle or outer door handle has switched the electrical switching element from position a (motor current line is interrupted and signal current line is complete) to position b (motor current line is complete and signal current line is interrupted), the control module enables the motor current on account of the signal on the signal line. At the same time, the motor current connection is complete in position b of the electrical switching element, which means that the motor lifts out the detent pawl.

In a further variant of the circuit arrangement according to the invention, a closing aid can be actuated. A closing aid can be used to pull the detent portions from the safety catch into the principal catch under motor control. Since this automatic operation carries the risk of articles and body parts getting trapped, the closing aid operation must be interruptable. During the closing aid operation, the detent pawl also falls into the principal catch, however. For this reason, when the closing aid operation is interrupted, the detent portions need to be moved into the open position. This is the case with the inventive arrangement of the electrical switching element, since the closing aid operation is interrupted as follows: the control module stores the start of the closing aid operation. During the closing aid operation, a signal current flows via the electrical switching element to the control module and is evaluated therein. In the event of something getting trapped, the inner door handle or outer door handle is pulled. This prompts the electrical switching element to interrupt the signal current. At the same time, the supply line for the motor current is completed. After the control module has recognized that the signal current has been interrupted, the control module stops the supply of current to the closing aid motor, so that the latter stops. At the same time, the control module switches on the current for the motor for the detent portions. Since the motor current line of the detent portion motor is complete as a result of operation of the electrical switching element, the detent pawl motor is actuated and lifts out the detent portions.

In all variants, it is possible for the same poles and the same line to be used to route both a motor current and a signal current from the control module to the electrical switching element. If the electrical switching element is in the connected position for the signal current, a small current flows between the pole of the control module and the electric actuating element at reduced voltage. If the signal line is opened and the motor current line is completed, however, the same poles and lines carry a much higher motor current and the voltage of the onboard power supply system. This variant simplifies the circuit design and hence costs.

For appropriate design of the door, the inner door handle and the outer door handle can act on the same electrical switching element. This reduces the electrical circuit complexity and electrical sources of error, e.g. wearing-through of the electric lines. Implementation of this requires a mechanical system. Alternatively, it is also possible for the inner door handle and the outer door handle to act on respective different electrical switching elements, however. Which variant is preferable is dependent on the circumstances in the vehicle.

In addition, the control module can enable the signal current only after evaluation of further sensor signals, e.g. crash sensor, speed detection unit or sensors for the closing states. By introducing signals from the crash sensor into the control module, for example, it is possible to switch off the supply of current to the detent pawl motor. This switching prevents the door from being opened as a result of operation of the inner door handle or outer door handle by centrifugal forces or in the event of the door being deformed.

The method for actuating a detent mechanism protects a motor vehicle door against inadvertent opening. A prerequisite is that the detent mechanism needs to be opened automatically. This is preferably achieved by an electric motor. The motor is actuated by a control module. Said control module receives an electrical signal for opening the door. This signal is processed in the control module and enables the motor current. However, the control module and the motor have an additional electrical switching element arranged in series between them. This electrical switching element may be any desired element which completes a circuit. The electrical switching element is operated by the outer or inner handle. Only when said electrical switching element has completed the motor circuit is the motor able to start and open the detent mechanism. If the control module now enables the motor current on account of an error without an operating element having been activated, the detent mechanism is not opened, since the circuit is interrupted on account of the electrical switching element. The electrical switching element remains closed only for as long as the operating element is activated. This is used for the operating safety of the method. If a latching electrical switching element were used, the circuit would also be able to be complete even if the operating element were not operated, and the detent mechanism would be able to open the motor vehicle door in the event of the motor current being erroneously enables by the control module.

If a toggle switch is used as the electrical switching element, the toggle switch could be used to route both the motor current and a signal current for actuating the control module. In this context, toggle switches are understood to mean all switching elements which have at least one input and two outputs, e.g. switches, reed switches, Hall sensors, pushbutton switches, relays. To this end, a signal current flows via a pole of the toggle switch to the control module permanently, in pulsed fashion or after a wake-up operation. If this signal current is interrupted by the toggle switch, this is recognized by the control module, which enables the motor current. Changeover of the toggle switch to the other pole completes the motor circuit, so that the motor opens the detent mechanism. This variant therefore saves material and assembly costs.

The control signal can also be used to activate other functions of the control module. It is particularly advantageous if, besides the additional function, the detent mechanism also needs to be put into the open position. This is necessary when a closing aid operation is interrupted, for example. To this end, the control module knows when a closing aid operation is taking place. If said operation is intended to be interrupted, the toggle switch needs to be changed over. The control module recognizes the interrupt command from the interruption in the signal and stops the supply of current to the closing aid motor. At the same time, the control module enables the motor current for the detent mechanism motor. The changeover of the toggle switch completes the circuit for the detent mechanism motor, as a result of which the detent mechanism moves into the open position.

Since the toggle switch has an input and two outputs and one pole carries the signal current and the other pole carries the motor current, the supply line must carry both the signal current and the motor current. The same applies to the switching tab. This also carries both a motor current and the signal current. This circuit minimizes the number of lines and hence the installation complexity.

For design reasons, it may be necessary to use two electrical operating elements, e.g. one for the outer door handle and one for the inner door handle. Since the outer door handle and the inner door handle are physically separate from one another, the inner door handle usually being positioned in the dry space and the outer door handle being positioned in the wet area, it is usually simpler for the purposes of assembly to replace the mechanical connecting elements with electrical ones.

Besides the signals from the electrical switching element, it is possible to have the control module also evaluate further signals. It is thus possible for, by way of example, sensors for the closing states or the speed detection unit, or the signals from the crash sensor, also to be evaluated. Thus, the control module may be designed such that the motor for the detent elements is not supplied with current when the vehicle is moving (speed detection), the vehicle is in the locked state or there is currently a crash situation. Alternatively, the control module can process signals for opening the detent mechanism. Thus, the control module can supply current to the motor, for example, when an external sensor recognizes an instance of something getting trapped. The instances presented in this regard serve only as examples. The nature and large number of the signals to be evaluated are limited only by the equipment of the vehicle.

The controller prevents inadvertent opening of a vehicle door, e.g. by an erroneous signal from the control module. The control module is understood to mean a unit which picks up and evaluates electrical signals, e.g. switch signals, sensor signals, and optionally enables the motor current for the electric detent mechanism motor. As an alternative to the motor, however, it is also possible to use a motor/gear unit, a linear motor, a solenoid, a shape memory element or any other apparatus which converts electrical energy into motion. The activation of the motor releases the detent mechanism, which opens the motor vehicle door. In addition to the control module, an electrical switching element is arranged in the circuit of the motor, said switching element being operated directly or by means of mechanical or electrical aids by the inner door handle and/or by the outer door handle. Said switching element is preferably a switch, reed switch, Hall sensor, pushbutton switch, relay or other switching element which interrupts the motor current line in the position of rest.

For the purpose of opening the door, operation of the outer door handle or inner door handle produces a signal which is routed to the control module, which enables the motor current. At the same time, operation of the inner door handle or outer door handle switches the electrical switching element and thereby completes the motor circuit, so that the detent mechanism opens the motor vehicle door. If the control module now produces an erroneous signal to open the detent mechanism, it is not possible for current to be supplied to the motor, since the electrical switching element has interrupted the motor current line.

If the electrical switching element is a two-pole switch, one pole can be used to produce a signal which is evaluated by the control module in order to use the signal for enabling the motor current. This signal can be produced by a current at a usual signal voltage and a usual signal current level, which current is interrupted when the two-pole switch is changed over. The signal current is interrupted as a result of the two-pole switch being changed over. This interruption is recognized by the control module, which enables the motor current, sometimes also taking account of other signals. The changeover of the switch completes the motor circuit, so that the motor current enabled by the control module flows.

As a further distinct aspect, which is subsequently rendered using somewhat different terminology, the present invention relates to a motor vehicle lock arrangement having a motor vehicle lock and an operating element which is associated with the motor vehicle lock, particularly a door handle, wherein an opening drive having an electric DC motor is provided which is used for opening the motor vehicle lock under motor control, wherein the opening drive can be adjusted in a first drive direction and in a second drive direction, wherein the motor vehicle lock can be opened by adjusting the opening drive in one of the two drive directions, wherein a control unit for the opening drive is provided, wherein the driver output of the control unit can be used to output a driver voltage for the opening drive, wherein a switch unit associated with the operating element is provided particularly for the purpose of initiating the opening of the motor vehicle lock under motor control.

An essential feature on the basis of this further aspect is the fact that the driver voltage at the driver output of the control unit always has one and the same polarity, that the switch unit is connected between the driver output of the control unit and the opening drive and that the switch unit switches through the driver voltage to the opening drive with a first polarity or with a second polarity, depending on the switch position.

The further aspect is based on the consideration that the driver output of the control unit provides a driver voltage having one and the same polarity in all cases and that any polarity reversal in the driver voltage which may be required for the first drive direction or the second drive direction of the opening drive is provided by a switch unit which is associated with the operating element.

The unipolar driver voltage first of all allows simplification of the design of the control unit. The power stage of the control unit requires only a simple half-bridge in this case.

However, a particular advantage is the fact that, with appropriate design, erroneous supply of current to the opening drive on account of the control unit does not at any rate result in an inadvertent motor-controlled opening operation with the solution based on the proposal. Preferably, when the operating element has not been operated, a driver voltage applied to the driver output is switched through to the opening drive by means of the switch unit with such polarity that the driver voltage cannot prompt motor-controlled opening at any rate. When the operating element has not been operated, motor-controlled opening is thus not possible.

FIG. 1 shows the schematic diagram of the motor vehicle door according to the invention with a detent pawl motor 11 which drives a detent pawl—not shown—in a motor vehicle lock. The detent pawl motor 11 is connected to pin 9 of the control module 12 by the line 14. The second motor line 15 is routed to the electrical switching element 13, which is in the form of a closing pushbutton switch.

The second pole of the electrical switching element 13 is connected to pin 3 of the control module 12 by means of line 17. Both the inner door handle 18 and the outer door handle 19 operate the electrical switching element 13 by means of the lever 20. In this case, the lever 20 may comprise a plurality of elements, that is to say including a lever chain. The inner door handle 18 and the outer door handle 19 are shown schematically by an arrow. These may also be a juxtaposition of different mechanical elements.

When the inner door handle 18 or outer door handle 19 is operated, switching elements—not shown—are used to send a signal to the control module 12, which supplies current to the detent pawl motor 11. At the same time, when the inner door handle 18 or outer door handle 19 is operated, the make contact 13 is changed to the closed position (see FIG. 2). The motor current can therefore flow from pin 9 via the motor 11 and the pushbutton switch 13 to pin 3 of the control module, which lifts out the detent pawl.

If the control module 12 switches on the motor current on account of an erroneous signal without the pushbutton switch 13 having been closed by means of the inner door handle 18 or outer door handle 19 (see FIG. 1), the circuit between pin 9 and pin 3 is interrupted on account of the position of the pushbutton switch 13, which means that the circuit of the detent pawl motor is not complete and hence the detent pawl is not lifted out.

FIG. 3 shows the schematic diagram of the motor vehicle lock according to the invention, in which the electrical switching element 13 both produces the opening signal for the control module 12 and completes the circuit for the detent pawl motor 11. The detent pawl motor 11 is connected to pin 9 of the control module 12 by the line 14. The second motor line 15 is routed to pole b of the electrical switching element 13, which is in the form of a mechanically operable toggle switch. Pole a of the electrical switching element 13 is connected to pin 2 of the control module 12 by means of line 16. Power is supplied via pole c on the electrical switching element 13, which is connected to pin 3 of the control module 12 by means of the line 17. Both the inner door handle 18 and the outer door handle 19 operate the electrical switching element 13 by means of the lever 20.

In the position of rest, a signal current of approximately 5 to 50 mV at approximately 4 V-14 V flows via pin 2 of the control module 12. Usually, a signal current of 10 mA at a voltage of 5 V is used. However, since the drive current for the detent pawl motor 11 also flows between pole c of the electrical switching element 13 and pin 3 of the control module 12, it is also possible to use a signal current of 12 V. The use of 4 V or 14 V is possible, since pin 3 is earthed. The signal current can be enabled continuously, in pulsed fashion or only after a wake-up operation in the control module. In the unoperated state, the signal current flows via pole a and pole c of the electrical switching element 13 to pin 3 of the control module.

When the inner operating lever 18 or the outer operating lever 19 is operated, the signal current is, as shown in FIG. 4, interrupted between pin 2 and pin 3 of the control module. At the same time, contact is made with pole c and pole b of the electrical switching element 13. The control module recognizes the interruption in the signal current and uses pin 9 of the control module 12 to switch on the detent pawl motor current. The detent pawl motor current now flows from pin 9 to the detent pawl motor and is routed via pole b and pole c of the electrical switching element 13 to pin 3 of the control module 12, which is earthed. In this case, the detent pawl of the motor vehicle lock is lifted out, which opens the motor vehicle door. The electrical switching element then reverts to the position of rest shown in FIG. 3. Customary detent pawl motor currents are between 2 A and 8 A at a voltage of 12 V. A current of approximately 5 A at 12 V is preferable.

FIG. 5 shows a further variant of the schematic diagrams described above. In this variant, the inner door handle 18 or the outer door handle 19 acts on the electrical switching element 13 independently of the respective other door handle. The levers or lever chains required for this purpose are indicated schematically in FIG. 5 by the contours 21.

On the basis of the schematic diagram as shown in FIG. 6, a closing aid can be actuated in addition to the detent pawl motor. A closing aid moves a motor vehicle door from the safety catch to the principal catch under motor control. Since this operation carries the risk of body parts and also articles getting trapped, it must be possible to interrupt the closing aid operation. The interruption is activated by pulling on the outer door handle 18 or inner door handle 19. During the closing aid operation, there is an interval in which the detent pawl is in the principal catch and the closing aid moves the latch into overtravel. In order to terminate the trapping process in this closing aid interval, the closing aid motor needs to be deactivated. At the same time, the detent pawl also needs to be put into the opening position. This requires the following actions:

Since the closing aid operation is a closing operation, the electrical switching element 13 is in the position of rest. In the position of rest, the detent pawl motor 11 is not being supplied with current and the poles c and a carry a signal current. At the same time, the closing aid motor 22 is supplied with current via pin 7 and pin 8 of the control module. The control module 12 knows that the closing aid operation is taking place. In order to interrupt the closing aid operation, it is necessary to pull on the inner door handle 18 or on the outer door handle 19. During this operation, the electrical switching element changes over from pole a to pole b. This involves the signal current being interrupted. This is recognized by the control module 12, which deactivates the closing aid motor 22. At the same time, the control module 12 uses the pin 9 to activate the detent pawl motor. The motor current flows via the pole c and the pole b to pin 3 of the control module 12 on account of the inner door handle 18 or the outer door handle 19 having been pulled. The detent pawl therefore moves into the opening position.

FIG. 7 shows a variant in which the inner door handle 18 is associated with an electrical switching element 13A and the outer door handle 19 is associated with a second electrical switching element 13B. The mechanical connection of the electrical switching elements 13A and 13B, which is shown schematically in FIG. 7, has already been described in the explanations relating to FIG. 5. In the position of rest, a signal current flows for the inner door handle 18 via pin 1 of the control module 12, via pole a and pole c of the electrical switching element 13A and onward via the lines 17A and 17B to earth on the pin 3. If operation of the inner door handle 18 changes over the electrical switching element 13A, so that pole c and pole a are interrupted but contact is made with pole c and pole a, the control module 12 recognizes the signal change on pin 1 and connects the detent pawl motor current to pin 9. The detent pawl motor current now flows via line 14, the detent pawl motor 11, the line 15A, via pole b and pole c of the electrical switching element 13A, via the lines 17A and 17B to earth on pin 3 of the control module 12. The behaviour of the schematic diagram in the event of erroneous enablement on pin 9 has already been explained in the explanations relating to FIG. 1 and FIG. 2. The fact that the lines 17A and 17B need to pass on both signal currents and detent pawl motor currents has been explained in the description of FIG. 3.

If the outer door handle 19 is now operated, the electrical switching element 13B interrupts the signal current between pin 2 and pin 3 of the control module 12. This connects the detent pawl motor current to pin 9. The detent pawl motor current flows via line 14, the motor 11, via the line 15B, the electrical switching element 13B and the line 17B to pin 3. If the detent pawl is erroneously supplied with current by the control module 12, the detent pawl motor 11 does not start, because the circuit is interrupted by the outer door handle 19 when the electrical switching element 13 is not being operated (see description of FIG. 1 and FIG. 2). The reciprocal derivation of the signal current and of the detent pawl motor current via the line 17B has already been explained in the description of FIG. 3.

FIGS. 8 and 9 show a further embodiment, which has a switching element 13 for reversing the polarity of a driver voltage $U_T$ from the control module 12. In this case too, a detent pawl motor 11 in the above sense is provided which is part of an opening drive.

The driver output of the control module 12 can be used to output a driver voltage $U_T$ for the opening drive. The control module 12 is thus equipped with a power stage which provides appropriate driving power for the detent pawl motor 11. The driver voltage $U_T$ is preferably a pulse-width-modulated voltage which can be used to easily adjust the power which is to be output to the opening drive.

The illustrations in FIGS. 8 and 9 reveal that a switching element 13 associated with the operating element 19 is used particularly to initiate the motor-controlled opening of the motor vehicle lock.

An essential feature first of all is that the driver voltage $U_T$ at the driver output always has one and the same polarity. This means that polarity reversal of the driver voltage $U_T$, which is output at the driver output, by the control module 12 is not envisaged at any time. This results in a quite particularly simple design for the power stage of the control module 12, as will be explained.

Another essential feature is that the switching element 13 is connected between the driver output of the control module 12 and the opening drive and that the switching element 13 switches through a driver voltage $U_T$ to the opening drive with a first polarity or with a second polarity, depending on the switch position. In this case, the switching element 13 thus performs the function of a polarity reverser. The current paths in one switch position (unoperated operating element 19, FIG. 8) and in the other switch position (operated operating element 19, FIG. 9) are each shown as a dashed line in the drawing.

In this context, the term "switching through" can be understood in the broad sense. In particular, this term also covers step-up or step-down of the driver voltage $U_T$. It thus does not matter that the driver voltage $U_T$ "arrives" at an unalterable level on the opening drive.

The polarity of the driver voltage $U_T$ and the polarity of the drive voltage $U_A$, which is ultimately connected to the opening drive, can be taken from the illustration in FIG. 8 for the unoperated operating element 19 and from the illustration in FIG. 9 for the operated operating element 19.

When interpreted appropriately, the solution based on the proposal means that erroneous supply of current to the opening drive as a result of an error in the control module 12 does not in any event result in a motor-controlled opening operation.

An essential feature is that, for the unoperated operating element 19 (FIG. 8), a driver voltage $U_T$ which is output at the driver output is switched through to the opening drive by means of the switching element 13 with such polarity that the driver voltage $U_T$ cannot bring about motor-controlled opening in any event.

Specifically, in this case, the switching element 13 switches through the driver voltage $U_T$ with the first polarity when the operating element 19 is not being operated (FIG. 8), and this allows an adjustment to be made in the first drive direction, and the switching element 13 switches through the driver voltage $U_T$ with the second polarity when the operating element 19 is being operated (FIG. 9), and this allows an adjustment to be made in the second drive direction.

LIST OF REFERENCE SYMBOLS

| | |
|---|---|
| 11 | Detent pawl motor |
| 12 | Control module |
| 13, 13A, 13B | Electrical switching element |
| 14 | Line between detent pawl motor and control module |
| 15, 15A, 15B | Line between detent pawl motor and electrical switching element |
| 16, 16A, 16B | Line between electric actuating element and control module |
| 17, 17A, 17B | Earth line between electrical switching element and control module (earth line) |
| 18 | Inner door handle |
| 19 | Outer door handle |
| 20 | Intermediate lever |
| 21, 21A, 21B | Contour for electrical switching element |
| 22 | Closing aid motor |
| 23 | Line between control module and closing aid motor |
| 24 | Earth line between control module and closing aid motor |
| a, b, c | Contacts of the pushbutton switches or switches |

The invention claimed is:

1. A circuit arrangement for a motor vehicle door, the circuit arrangement comprising a detent mechanism for keeping the motor vehicle door in the closed position and opening the motor vehicle door, an operating element, an electric drive for driving the detent mechanism, which electric drive is driven by a motor current, as a result of which the detent mechanism opens the motor vehicle door, a control module for switching on the electric drive by providing the motor current to the electric drive, an electrical circuit of the electric drive with a motor current line for relaying the motor current to the electric drive, and an electrical switching element arranged in the electrical circuit, which electrical switching element can be switched in a respective closed position and an open position, wherein the at least one electrical switching element interrupts the motor current line for the motor current in the open position and closes the motor current line in the closed position for the motor current, wherein the at least one electrical switching element is in the open position when the at least one electrical switching element is at rest, wherein the at least one electrical switching element is switched by actuation of the at least one operating element, wherein when the operating element is operated, the electrical switching element is switched in the closed position so that the motor current can therefore drive the electric drive.

2. The circuit arrangement according to claim 1, wherein the electrical switching element is a pushbutton switch.

3. The circuit arrangement according to claim 1, wherein the electrical switching element is a toggle switch having at least two poles.

4. The circuit arrangement according to claim 2, wherein the electrical switching element is positioned in a door handle unit.

5. The circuit arrangement according to claim 2, wherein the electrical switching element is positioned in the electric drive or close to the electric drive.

6. The circuit arrangement according to claim 3, wherein one pole of the toggle switch can be used to produce a signal by a signal current and the other pole of the toggle switch can be used to route a motor current.

7. The circuit arrangement according to claim 3, wherein a signal produced by the toggle switch prompts connection of a motor current in the control module.

8. The circuit arrangement according to claim 6, wherein the signal can actuate a closing aid and the electric drive for the detent mechanism can be activated within a short space of time.

9. The circuit arrangement according to claim 3, wherein at least one pole of the control module and of the electrical switching element can be used to route both a motor current and a signal current sequentially.

10. The circuit arrangement according to claim 1, wherein the operating element comprises an outer door handle and an inner door handle, wherein the inner door handle and the outer door handle are each provided with a separate electrical switching element.

11. The circuit arrangement according to claim 1, comprising one or more signal transmitters selected from a crash sensor, speed detection unit or sensors for the closing states, wherein one or more signal transmitters can be evaluated and used for enabling a motor current.

* * * * *